US008186212B2

(12) United States Patent
Romero et al.

(10) Patent No.: US 8,186,212 B2
(45) Date of Patent: May 29, 2012

(54) SHOCK AND VIBRATION ENVIRONMENTAL RECORDER FOR WELLBORE INSTRUMENTS

(75) Inventors: Edgar Romero, Houston, TX (US); Robert H. Kelly, Jr., Houston, TX (US); Thomas J. Rebler, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 371 days.

(21) Appl. No.: 12/579,450

(22) Filed: Oct. 15, 2009

(65) Prior Publication Data

US 2010/0095760 A1 Apr. 22, 2010

Related U.S. Application Data

(60) Provisional application No. 61/107,202, filed on Oct. 21, 2008.

(51) Int. Cl.
*E21B 47/00* (2012.01)

(52) U.S. Cl. ..... 73/152.58

(58) Field of Classification Search .. 73/152.46–152.49, 73/152.58

See application file for complete search history.

(56) References Cited

U.S. PATENT DOCUMENTS

| | | | | |
|---|---|---|---|---|
| 4,289,023 | A * | 9/1981 | Rader | 73/152.57 |
| 4,715,451 | A * | 12/1987 | Bseisu et al. | 175/40 |
| 5,226,332 | A * | 7/1993 | Wassell | 73/152.58 |
| 7,082,821 | B2 * | 8/2006 | Chen et al. | 73/152.47 |
| 7,571,643 | B2 * | 8/2009 | Sugiura | 73/152.46 |
| 2004/0206170 | A1 * | 10/2004 | Chen et al. | 73/152.49 |
| 2007/0289373 | A1 * | 12/2007 | Sugiura | 73/152.46 |

* cited by examiner

*Primary Examiner* — John Fitzgerald

(74) *Attorney, Agent, or Firm* — Darla P. Fonseen; Jody Lynn DeStefanis; Charlotte Rutherford

(57) ABSTRACT

A wellbore instrument includes a housing configured to traverse a subsurface wellbore. A shock and vibration sensor disposed in the housing and is mounted on a carrier disposed in the housing. The carrier includes at least two, laterally movable elements each having an outer surface configured to contact an inner surface of the housing. The carrier includes an adjustable wedge disposed between the opposed elements. The wedge is arranged such that longitudinal movement thereof causes lateral separation of the laterally movable elements into frictional engagement with the inner surface of the housing.

17 Claims, 5 Drawing Sheets

SHOCK AND VIBRATION ENVIRONMENTAL RECORDER FOR WELLBORE INSTRUMENTS

CROSS-REFERENCE TO RELATED APPLICATIONS

Priority is claimed from U.S. Provisional Application No. 61/107,202 filed on Oct. 21, 2008.

STATEMENT REGARDING FEDERALLY SPONSORED RESEARCH OR DEVELOPMENT

Not Applicable

BACKGROUND OF THE INVENTION

1. Field of the Invention

The invention relates generally to the field of instruments used to make measurements in subsurface wellbores. More specifically, the invention relates to structures for mounting shock and vibration sensors in such instruments to provide a more accurate indication of shock and vibration actually experienced by such instruments.

2. Background Art

Certain types of instruments are used to make measurements from within wellbores drilled through subsurface rock formations. Such instruments may be conveyed through the wellbore by various devices known in the art including armored electrical cable ("wireline"), slickline, coiled tubing, production tubing and by drill string. In the latter conveyance, certain of such instruments may be configured to make measurements during the actual drilling of the wellbore. Moving instruments along the interior of a wellbore, in particular during drilling, as well as handling and transportation to the well site, can impart shock and vibration to the instruments.

There is a need to properly characterize the shock and vibration levels that such instruments experience. Only through proper characterization of the shock and vibration environment to which such instruments are exposed can more accurate shock and vibration testing specifications be developed. More accurate shock and vibration testing specifications may assist in the design of more robust wellbore instruments.

A shock and vibration environmental recorder has been developed for placement inside a wellbore instrument. One such recorder is sold under model designation "SAVER 3×90" by Lansmont Corporation, Ryan Ranch Research Park, 17 Mandeville Court, Monterey, Calif. 93940. The shock and vibration recorder generally consists of triaxial accelerometers, analog to digital converters and appropriate analog and digital processing circuitry and digital memory or other data storage to store the measurements made for a selected time period.

However, such recorders cannot simply be placed in or on a tool and accurately characterize the shock and vibration experienced by the instrument. The sensing elements in a shock and vibration recorder are typically accelerometers that are mounted on a circuit board. The circuit board having the accelerometers must be mounted inside the instrument housing in a way that assures adequate mechanical coupling between the instrument housing and the circuit board.

It is known in the art to directly mount accelerometers and strain gauges directly on the instrument housing. While effective, such mounting can make servicing the instrument more difficult and expensive.

There exists a need for devices to mount shock and vibration sensors (e.g., accelerometers) that make instrument assembly convenient and accurate, and provide sensor mounting to the instrument housing that efficiently transfers acceleration from the housing to the shock and vibration sensors.

SUMMARY OF THE INVENTION

A wellbore instrument according to one aspect of the invention includes a housing configured to traverse a subsurface wellbore. A shock and vibration sensor is disposed in the housing and is mounted on a carrier disposed in the housing. The carrier includes at least two, laterally movable elements each having an outer surface configured to contact an inner surface of the housing. The carrier includes an adjustable wedge disposed between the opposed elements. The wedge is arranged such that longitudinal movement thereof causes lateral separation of the laterally movable elements into frictional engagement with the inner surface of the housing. In one example, longitudinal movement of the wedge may be performed by rotating a screw that threadedly engages an interior passage in the wedge.

In another example, a downhole tool comprising a shock and vibration recorder is provided. In various examples, the downhole tool comprising a shock and vibration recorder may be a wireline tool, a drill string or a logging while drilling tool.

A method for assembling a shock, acceleration and vibration sensing recorder to a well logging instrument according to another aspect of the invention includes inserting chassis components into a housing by sliding longitudinally therein to a selected position. The chassis components include a shock, acceleration and vibration sensor disposed in a carrier. The carrier is laterally expanded into frictional engagement with an interior surface of the housing.

The invention also provides a method of characterizing the shock and vibration levels that a downhole tool encounters during transportation, handling, rig up/down, and downhole operations comprising providing said downhole tool with a shock and vibration recorder, and transporting, handling, performing rig up/down procedures, and downhole operations with such downhole tool. This method may be used where the tool is a wireline tool, a drill string or a logging while drilling tool.

The invention also provides a method for mounting a board with accelerometers inside a downhole tool housing that assures adequate mechanical coupling to allow high quality shock and vibration measurements. This method may be used where the tool is a wireline tool, a drill string, coiled tubing or a logging while drilling tool, or a tool conveyed into a wellbore by any means known in the art The invention also provides a system for attaching a recorder to a downhole tool housing using a wedge system to push a board with accelerometers against the tool's housing.

In one example, the invention provides a system wherein the wedge system is activated with a screw after the tool has the tool chassis installed inside its housing. In some examples the activation may be performed in a way the optimizes the axial loading capability of the instrument without decreasing the instrument pressure rating (in other words, just tight enough to provide grip but without affecting the mechanical integrity of the tool housing it is mounted within.

Other aspects and advantages of the invention will be apparent from the following description and the appended claims.

DETAILED DESCRIPTION

Figure 1:
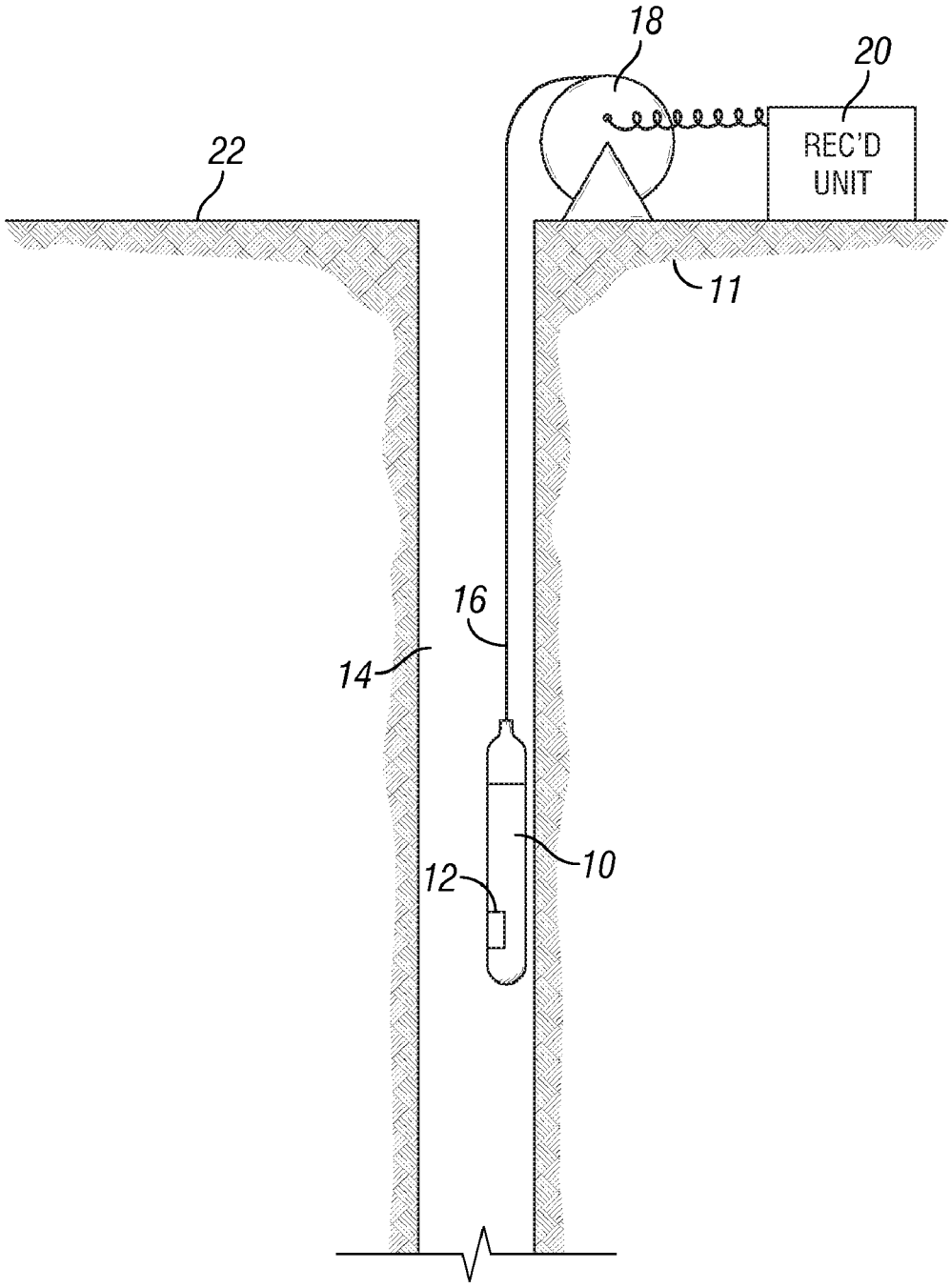
FIG. 1 shows a wireline conveyed instrument including a shock and vibration recorder.

One example of a wellbore instrument is shown schematically in FIG. 1 at 10. The instrument 10 can be configured to make any type of measurement known in the art from within a wellbore 14 drilled through subsurface rock formations 11. Without limitation, examples of such measurements include electrical resistivity, naturally occurring gamma radiation, neutron capture cross section, neutron hydrogen index, gamma gamma density, acoustic compressional and shear velocities, and samples of fluid and pressures thereof from the formation.

The instrument 10 includes a shock and vibration recording sensor 12 according to various aspects of the invention that will be explained in more detail below. The instrument 10 may be transported to the wellbore, "rigged up" and then conveyed along the wellbore 14 using, in the present example, an armored electrical cable 16. The cable 16 may be extended into and retracted from the wellbore 14 using a winch 18 or similar spooling device known in the art. Signals from various sensors including those in the shock and vibration recording sensor 12 may be communicated along the cable 16 for recording and/or processing in a recording unit 20 disposed at the surface. In other examples, the cable 16 may be substituted by "slickline." Accordingly, wireline conveyance is not a limit on the scope of the present invention. Because the shock and vibration recording sensor 12 may be configured to store signals locally, it may not be necessary in certain examples, to transmit measurements from such sensors 12 to the surface recording unit while the instrument 10 is in the wellbore 14. The sensors 12 may be interrogated after the instrument 10 is withdrawn from the wellbore 14.

Figure 2:
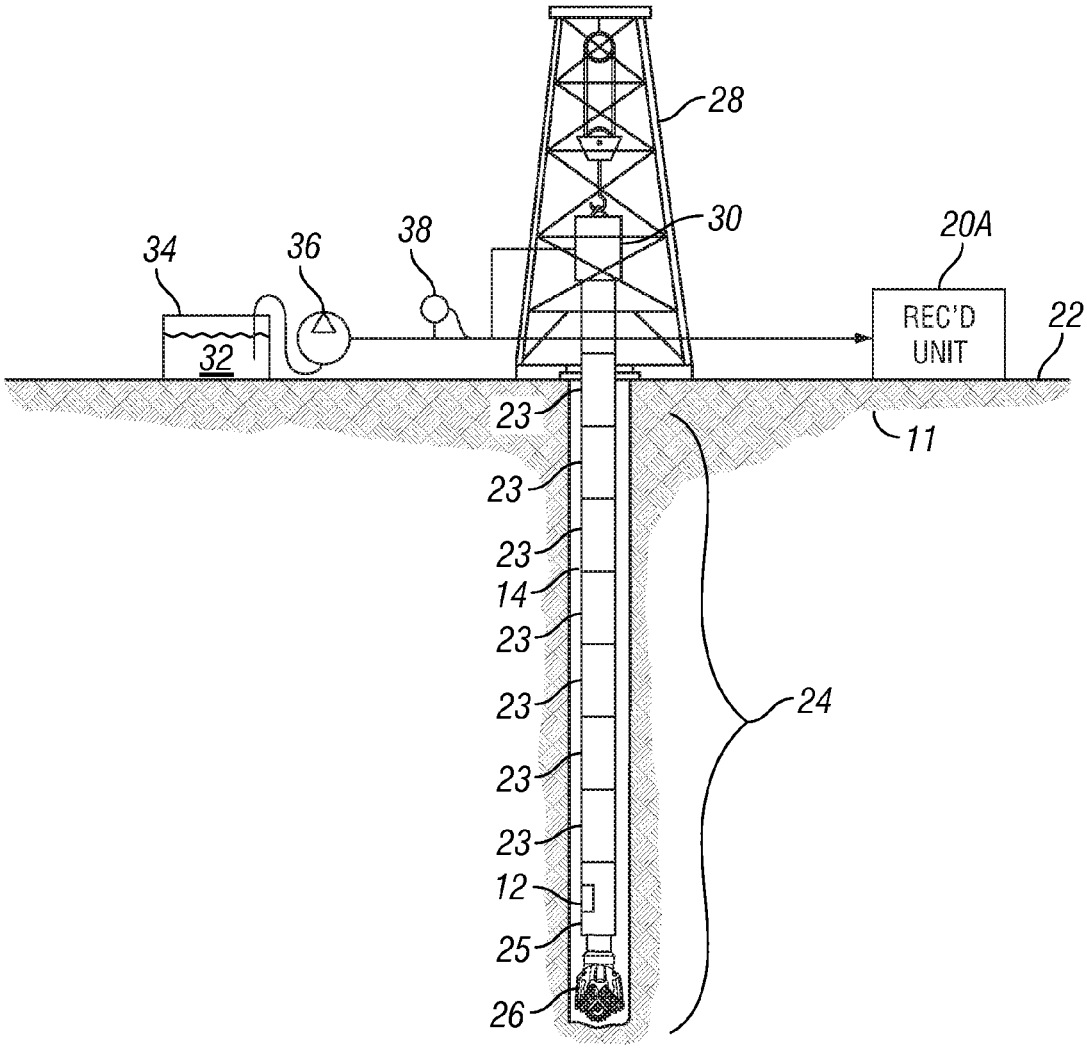
FIG. 2 shows a measurement and/or logging while drilling (drill string conveyed) instrument including a shock and vibration recorder.

FIG. 2 shows an example measurement while drilling (MWD) or logging while drilling (LWD) instrument 25 disposed in a drill string 24. "MWD" instruments are generally understood to be those types of instruments that make measurements corresponding to certain drilling parameters such as the geodetic trajectory of the wellbore, and mechanical drilling parameters affecting the drill string 24, e.g., torque and axial load (weight on bit). "LWD" instruments are generally understood to be those which make petrophysical parameter measurements of the types explained above with reference to FIG. 1. The present shock and vibration recording sensor is equally usable with MWD and LWD instruments. Accordingly, the types of measurements made in a drill string conveyed measurement system by the instrument 25 that are made in addition to the shock and vibration measurements are not intended to limit the scope of the invention.

The drill string 24 is generally assembled from segments ("joints") 23 of pipe threadedly connected end to end. A drill bit 26 is typically disposed at the bottom of the drill string 24 and is axially urged and rotated to lengthen (drill) the wellbore 14. The instrument 25 may also include a shock and vibration recorder. In the present example, the drill string 24 is suspended by a top drive 30 disposed in a hoisting unit such as a drilling rig 28. During drilling, a pump 36 lifts drilling fluid 32 ("mud") from a tank 34 and pumps it through an internal passage in the drill string 24. The mud 32 eventually leaves the drill string 24 through courses or nozzles (not shown) in the drill bit, whereupon it lifts drill cuttings as the mud 32 returns to the surface. The instrument 25 may be configured to modulate the flow of mud 32 in the drill string 24 so as to communicate signals from the instrument 25, including from the shock and vibration recorder 12, to a recording unit 20A at the surface 22. The modulation may be detected by one or more pressure transducers 38 disposed in the discharge line from the pump 36. Other techniques for communicating signals include using so-called "wired" drill pipe. Examples of such pipe are described in U.S. Pat. No. 6,641,434 issued to Boyle et al. and commonly owned with the present invention. As explained above with reference to FIG. 1, it may be unnecessary to transmit the shock and vibration measurements to the surface during the time the instrument 25 is in the wellbore. The instrument 25 may be interrogated after removal from the wellbore 14 because the instrument may have local data recording capability.

Irrespective of the type of instrument conveyance, proper operation of the shock and vibration recording sensor 12 requires good mechanical coupling between the sensing elements (typically being one or more circuit boards that include accelerometers to measure acceleration in mutually orthogonal directions) and the instrument housing. By such good mechanical coupling, it is believed that a more accurate characterization may be made of the shock and vibration experienced by the instrument because any mechanical contamination of the recorded vibration is minimized.

Figure 3:
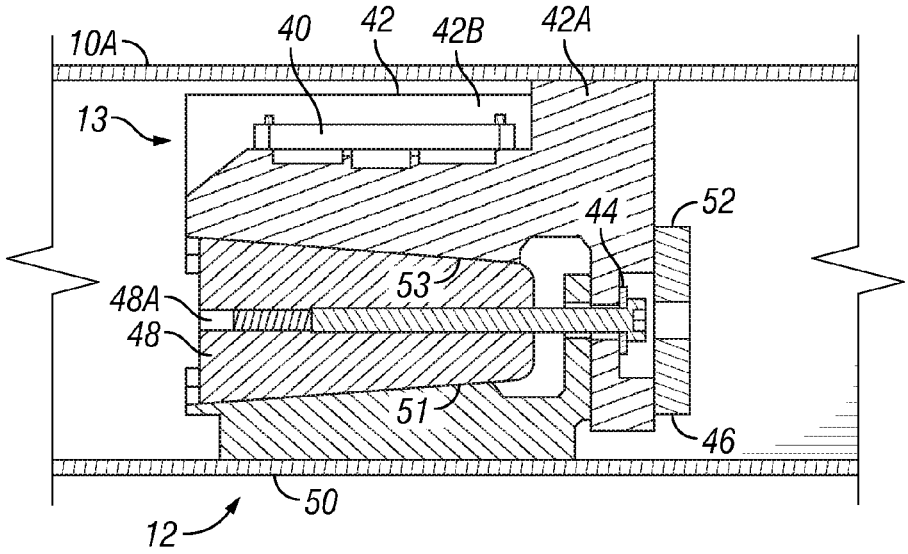
FIG. 3 shows an example carrier for a shock and vibration recorder (sensor assembly) in side view disposed in an instrument housing.

An example carrier 13 for a shock and vibration recording sensor is shown in cross section in FIG. 3. The carrier 13 in the present example includes an upper carrier 42, which has a receptacle 42B for holding a sensor board 40. In the present example, the sensor board 40 can be a triaxial accelerometer sensor assembly based on a recording sensor assembly sold under model designation SAVER 3×90 by Lansmont Corporation, Ryan Ranch Research Park, 17 Mandeville Court, Monterey, Calif. 93940. Such sensor board 40 typically includes three mutually orthogonal accelerometers, analog to digital conversion and signal processing circuitry, and a data recorder. The upper carrier 42 may include a radiused feature 42A configured to contact with and conform to the inner surface of the instrument housing 10A. Disposed laterally opposite to the upper carrier 42 may be a carrier base 50. The carrier base 50 is also configured to contact and conform to the inner surface of the housing 10A, typically diametrically opposite to the upper carrier 42. The carrier base 50 and the upper carrier 42 may have opposed, tapered inner surfaces, shown at 51 and 53, respectively. The opposed, tapered inner surfaces 51, 53 may be generally semi-conical in shape, or may be planar tapered, and provide a corresponding opening for a wedge 48. The wedge 48 may be a generally conically or flat shaped wedge 48. The wedge 48 may include a threaded, centrally disposed opening 48A therethrough. A screw 46, such as a socket head (Allen) screw may be disposed in the narrow end of the wedge opening 48A, and supported, for example, by a thrust washer 44. Upon rotation of the screw 46, the wedge 48 is drawn longitudinally along the corresponding inner surfaces 51, 53, causing the diameter traversed between the upper carrier 42 and the carrier base 50 to increase. Thus, by suitable operation of the screw 46, the upper carrier 42 and carrier base 50 may become laterally displaced and thus tightly compressed against the inner surface of the housing 10A. Such compression may enable efficient transfer of acceleration applied to the housing 10A to the carrier 13 and thus to the accelerometers on the sensor board 40 for recording and analysis.

The screw 46 may be covered by a cap 52 fastened to the ends of the upper carrier 42 to protect the screw 46 and parts of the carrier 42, 50 during operation. The cap 52 provides the function of allowing the screw 46 to push the wedge outwardly to release the carrier assembly 13 from the housing 10A. As the screw 46 is reverse rotated, it moves closer to the cap 52, then touches the cap. If reverse rotation of the screw 46 continues the cap 52 prevents the screw 46 from moving relative to carrier parts 42 and 50, and creates a force that causes the wedge 48 to disengage from carrier 42 and 50, thus releasing the carrier assembly 13 from the inner surface of the housing 10A.

Figure 4:
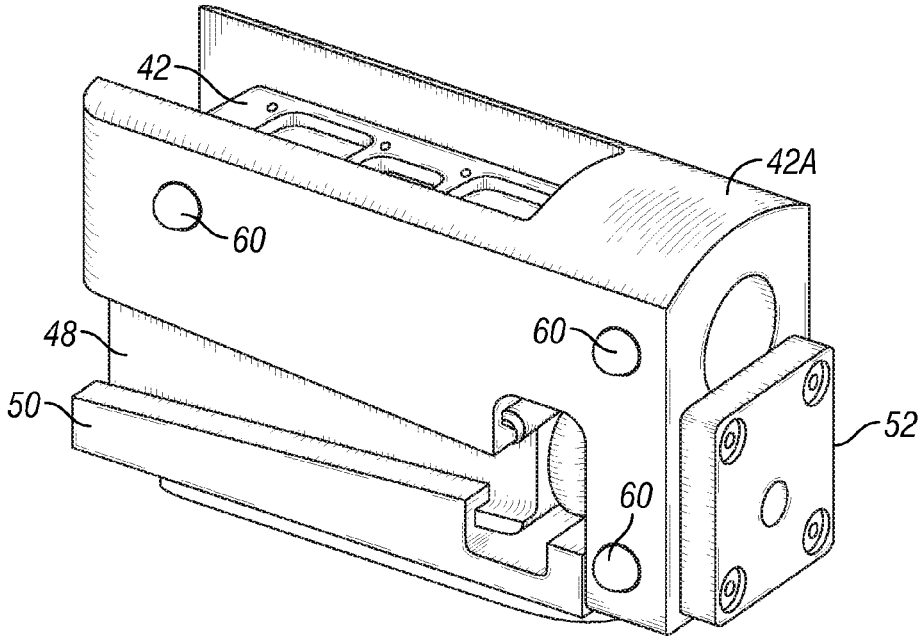
FIG. 4 shows an oblique view of the assembled carrier.
Figure 5:
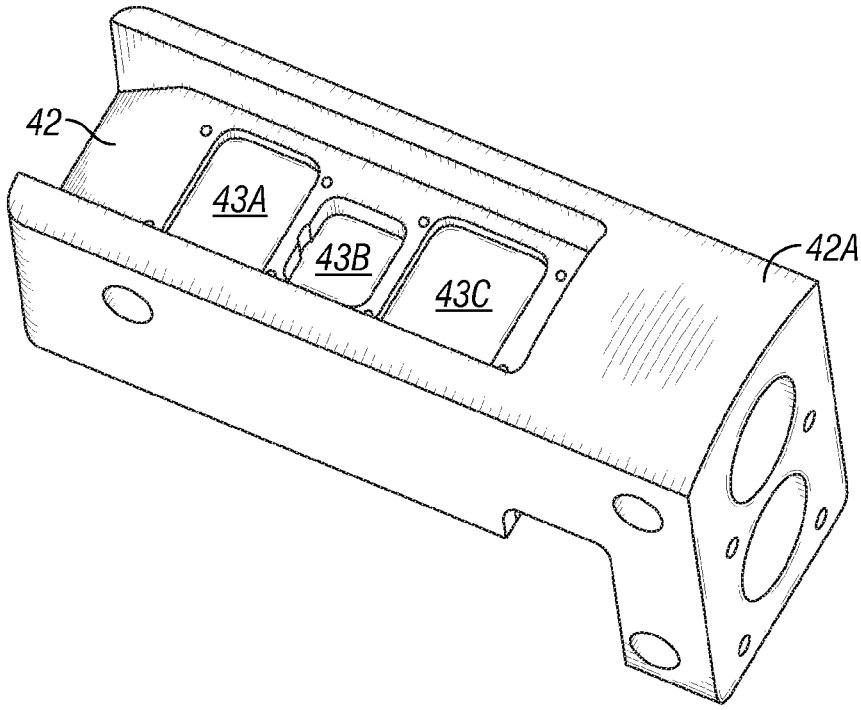
FIG. 5 shows an oblique view of the circuit board holding component of the carrier.
Figure 8:
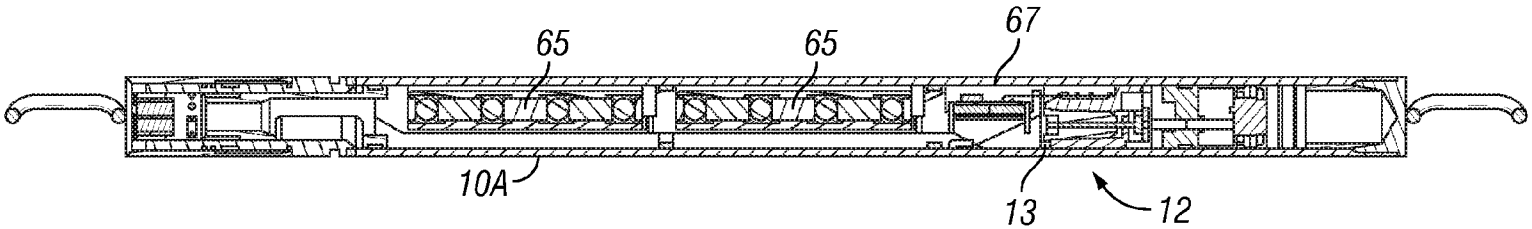
FIG. 8 shows an assembled wireline tool including a shock and vibration recorder according to the various aspects of the invention.

A side view of the assembled carrier 13 is shown in FIG. 4. In the present example, the carrier 13 may include elastomer (e.g., rubber) plugs or stand offs to isolate the carrier 13 from acceleration transferred from electronic support chassis (FIG. 8) and other components inside the housing (10A in FIG. 3). An upper oblique view of the carrier is shown in FIG. 5, wherein reliefs 43A, 43B, 43C for components on the bottom of the sensor board (40 in FIG. 3) can be observed.

Figure 6:
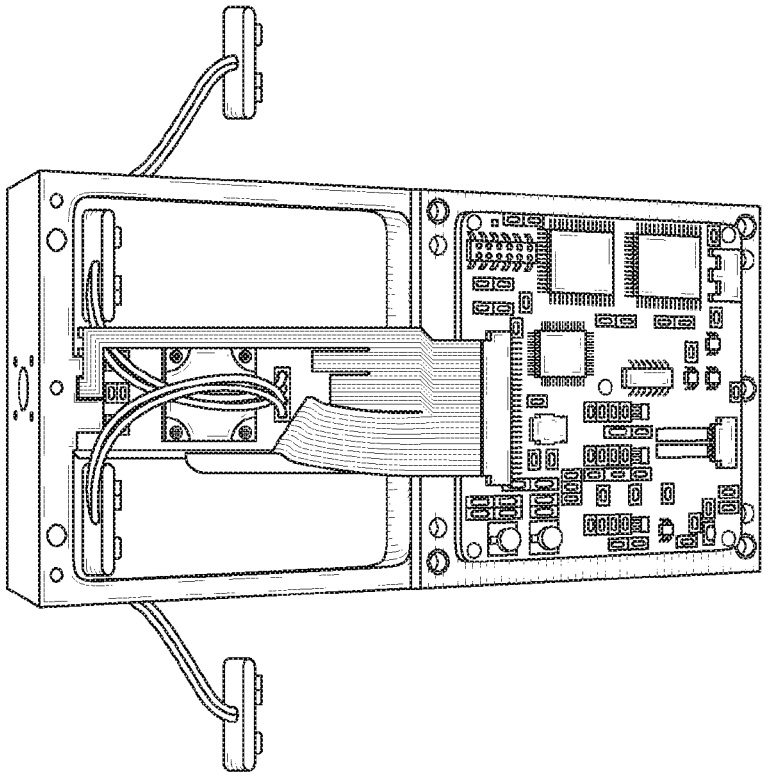
FIG. 6 shows an example of a triaxial accelerometer measurement circuit board on the left, and a controller circuit board on the right.

An oblique view of the sensor board 40 is shown in FIG. 6. The sensor board may be self-contained and may be powered, for example by using batteries.

Some of the design considerations for this example of the wedge, upper carrier and carrier base to function optimally include the following. The taper angle of the wedge was chosen to maximize the normal force between the interior surface of the housing (10A in FIG. 3) and the carrier. Maximizing the normal force is used to provide enough friction to transfer acceleration efficiently, while at the same time keeping the normal force between the different parts of the carrier assembly low enough to minimize the probability of galling. Copper based alloys may be used in the wedge (48 in FIG. 3) to further decrease the possibility of galling. The materials may also selected in such a way that under thermal expansion the wedge assembly increases the contact force with the housing 10A.

The carrier (13 in FIG. 3) relies on friction to hold it in place during shocks, particularly in the direction of the longitudinal axis of the instrument housing (10A in FIG. 3). Therefore the contact surfaces between the upper carrier (42 in FIG. 3) and the inner surface of the housing (10A in FIG. 3) and the inner surface of the housing and the carrier base (50 in FIG. 3) require rougher surface finish than ordinarily finished machined metal parts would have to increase the acceleration levels that the device can sustain without slippage. Such extra roughness may be limited only to the portions of the interior of the housing (10A in FIG. 3) where the carrier 13 will be positioned in order to minimize additional friction to other components to be inserted into the housing.

The weight of the carrier 13 can be minimized, e.g., by selecting a shape to cover only a limited portion of the circumference of the interior of the instrument housing (10A in FIG. 3) to decrease the inertial forces experienced during high level shocks, while retaining the rigidity of the assembly to avoid compromising the acceleration measurements quality.

The radii of the upper carrier (42 in FIG. 3) and carrier base (50 in FIG. 3) surfaces that contact the inner surface of the instrument housing (10A in FIG. 3) should be as closely matched as possible to the radius of the inner surface of the instrument housing (10A in FIG. 3) to maximize contact area, but should also be selected such that the upper carrier assembly and the carrier base contact the housing inner surface along two circumferentially displaced, essentially parallel lines (on the sides) rather than along the center line. Such contact will provide lateral stability of the carrier assembly and will lessen the possibility of incorrectly measured lateral shock and vibration.

Figure 7:
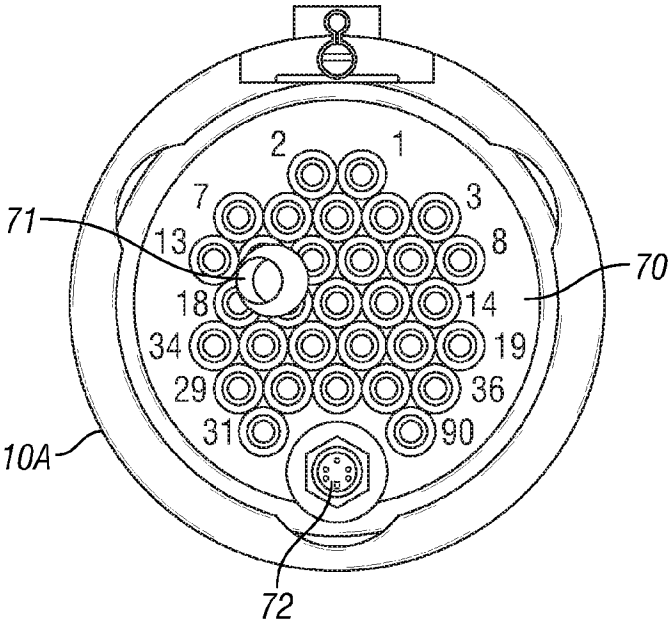
FIG. 7 shows a lower connector head for a wireline instrument that includes access to the wedge screw of FIG. 3.

An example of a conventional wireline multiple pin lower electrical connector 70 is shown disposed inside the housing 10A. The present example connector is modified to include an opening 71 in the connector 70 to provide access to the wedge locking and unlocking screw (46 in FIG. 3), and access to a USB port 72 on the sensor board (40 in FIG. 3). In the present example, and referring to FIG. 8, an instrument chassis set, which may include batteries 65 and main circuits 67 may be assembled with the carrier 13 conventionally by sliding all the foregoing into their correct respective positions in the housing 10A. The wedge screw (44 in FIG. 3) may be tightened using the access hole (71 in FIG. 7) in the lower connector (70 in FIG. 7), thus locking the carrier 13 in place.

The foregoing assembly was subjected to shock and vibration testing. The carrier (13 in FIG. 3) did not move with respect to the housing (10A in FIG. 3) throughout shock and vibration testing, assuring a transmissibility of 100% of the acceleration from the housing to the carrier. Likewise, the screw (44 in FIG. 3) did not lose any of the torque applied at installation even after a large number of repeated high level shocks as well as intense vibration testing.

A shock and vibration sensor and carrier made according to the various aspects of the invention may facilitate instrument assembly and service, while providing accurate measurement of the shock and vibration forces experienced by the instrument.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A wellbore instrument comprising:

A housing configured to traverse a subsurface wellbore;

A shock and vibration sensor disposed in the housing, the shock and vibration sensor mounted on a carrier disposed in the housing;

wherein the carrier includes at least two laterally movable elements each having an outer surface configured to contact an inner surface of the housing, and wherein the carrier includes an adjustable wedge disposed between the opposed elements, the wedge arranged such that longitudinal movement thereof causes lateral separation of the laterally movable elements into frictional engagement with the inner surface of the housing.

2. The instrument of claim 1 wherein the outer surfaces of the laterally movable elements each has a radius selected such that contact with the inner surface of the housing occurs along two circumferentially separated lines.

3. The instrument of claim 1 wherein the carrier includes a cover plate on one longitudinal end thereof.

4. The instrument of claim 1 wherein one of the movable elements includes recess features configured to accept elements disposed on a lower side of the shock and vibration sensor.

5. The instrument of claim 1 wherein the shock and vibration sensor comprises a triaxial accelerometer.

6. The instrument of claim 1 wherein the wedge comprises material selected to reduce galling between the wedge and the laterally movable elements.

7. The instrument of claim 1 wherein the wedge comprises material selected such that thermal expansion of the wedge results in at least a same compressive force between the housing and the laterally movable elements.

8. The instrument of claim 1 wherein the interior surface of the housing where contacted by the laterally movable elements and an exterior surface of the laterally movable elements comprises a surface roughness higher than in other portions of the interior surface of the housing.

9. The instrument of claim 1 wherein the wedge includes an internally threaded passage and a screw is engaged with the passage to cause longitudinal movement of the wedge.

10. The instrument of claim 9 wherein the screw is accessed through an opening in an electrical connector disposed in the housing.

11. A method for assembling a shock and vibration recorder to a well logging instrument, comprising:

inserting chassis components into a housing by sliding longitudinally therein to a selected position, the chassis components including a shock and vibration sensor disposed in a carrier;

laterally expanding the carrier into frictional engagement with an interior surface of the housing.

12. The method of claim 11 wherein the laterally expanding comprises turning a screw operably associated with a wedge, wherein the wedge is configured such that longitudinal motion thereof causes lateral separation of the carrier.

13. The method of claim 11 wherein the screw is accessed through an opening in an electrical connector disposed in the housing.

14. A method for recording acceleration experienced by an instrument in a wellbore, comprising:

moving the instrument along the interior of the wellbore;

measuring acceleration imparted to the instrument along at least one direction, the measuring acceleration performed by an acceleration sensor disposed in the instrument and mounted on a carrier disposed in the instrument;

wherein the carrier includes at least two laterally movable elements each having an outer surface configured to contact an inner surface of the instrument, and wherein the carrier includes an adjustable wedge disposed between the opposed elements, the wedge arranged such that longitudinal movement thereof causes lateral separation of the laterally movable elements into frictional engagement with the inner surface of the instrument.

15. The method of claim 14 further comprising measuring acceleration in two directions mutually orthogonal to the at least one direction.

16. The method of claim 14 wherein the inner surface proximate the laterally movable elements has a rougher surface finish than at other places along the inner surface.

17. The method of claim 14 further comprising recording the measurements of acceleration using a recorder disposed in the instrument.

* * * * *